US006751919B2

(12) United States Patent
Calixto

(10) Patent No.: US 6,751,919 B2
(45) Date of Patent: Jun. 22, 2004

(54) SEALING ELEMENT FOR EXPANSION JOINTS

(76) Inventor: Jorge Gabrielli Zacharias Calixto, Avenida Miguel Frias de Vasconcelos, 1.309, São Paulo (BR), CEP 05345-000

( * ) Notice: Subject to any disclaimer, the term of this patent is extended or adjusted under 35 U.S.C. 154(b) by 66 days.

(21) Appl. No.: 10/052,614

(22) Filed: Jan. 17, 2002

(65) Prior Publication Data

US 2002/0088192 A1 Jul. 11, 2002

Related U.S. Application Data

(63) Continuation of application No. PCT/BR00/00081, filed on Jul. 19, 2000.

(30) Foreign Application Priority Data

Jul. 19, 1999 (BR) ..... 9903326

(51) Int. Cl.[7] ..... E04B 1/604

(52) U.S. Cl. ..... 52/573.1; 52/582.1; 52/302.6; 52/396.03; 52/396.04; 52/396.06; 52/396.08; 52/364; 52/393; 52/459; 52/464; 52/470; 52/471; 52/396.07; 404/49; 404/68; 404/69; 404/72; 404/75

(58) Field of Search ..... 52/573.1, 582.1, 52/396.03, 396.06, 396.07, 302.6, 396.02, 364, 464, 393, 396.04, 396.08, 459, 470, 471; 404/69, 68, 72, 75, 49

(56) References Cited

U.S. PATENT DOCUMENTS 1,357,713 A * 11/1920 Lane ..... 52/464
3,015,195 A * 1/1962 Clark ..... 451/26
3,124,047 A * 3/1964 Graham ..... 404/47
3,172,237 A * 3/1965 Bradley ..... 52/99
3,192,577 A * 7/1965 Barr ..... 52/364

(List continued on next page.)

FOREIGN PATENT DOCUMENTS

| | | | |
|---|---|---|---|
| CA | 2106352 | 3/1993 | |
| DE | 1275266 | 8/1968 | |
| DE | 3038524 | 4/1982 | |
| EP | 648916 A1 * | 4/1995 | ..... E21D/11/38 |

*Primary Examiner*—Brian E. Glessner
*Assistant Examiner*—Christy M. Green
(74) *Attorney, Agent, or Firm*—Darby & Darby

(57) ABSTRACT

A sealing element for the recessed seat of an expansion joint in a concrete structure having an elastomeric profile (20) formed by two longitudinal lateral flanges (21) to be fixed to the end edges of the concrete structure (11), and a central portion (22) formed by walls depending from said flanges and converging to a central area to be fitted inside the seat (12), and shaped to support the hydrostatic pressure upstream of the concrete structure (10). A flexible duct (30) is installed inside the seat (12) below the central portion central area and provided with radial bores (31) opened to the inside of the seat to allow the selective feeding of precatalyzed polymeric resin to the inside of the seat (12), after the elastomeric profile (20) has been mounted and affixed to the concrete structure (10). The tube can be separate from the profile, attached to the central area, or the central area can have a W shape and the tube be within the lower portion of the W.

11 Claims, 3 Drawing Sheets

U.S. PATENT DOCUMENTS 3,410,037 A * 11/1968 Empson et al. ..... 52/58
3,411,260 A * 11/1968 Dill ..... 52/396.03
3,667,174 A * 6/1972 Arnett ..... 52/100
3,838,931 A * 10/1974 Valla ..... 404/69
3,951,562 A * 4/1976 Fyfe ..... 404/68
3,964,220 A * 6/1976 Rutkowski et al. ..... 52/100
3,977,802 A * 8/1976 Galbreath ..... 404/69
3,992,121 A * 11/1976 Geiger ..... 404/47
4,059,933 A * 11/1977 Funk et al. ..... 52/127.12
4,067,155 A * 1/1978 Ruff et al. ..... 52/105
4,080,086 A * 3/1978 Watson ..... 404/69
4,084,912 A * 4/1978 Pyle et al. ..... 404/74
4,127,350 A * 11/1978 Weber ..... 404/65
4,141,189 A * 2/1979 Borjeson ..... 52/396.06
4,285,612 A * 8/1981 Betti ..... 404/68
4,371,283 A * 2/1983 Lampertz ..... 403/288
4,447,172 A * 5/1984 Galbreath ..... 404/68
4,572,702 A * 2/1986 Bone ..... 404/65
4,651,488 A * 3/1987 Nicholas et al. ..... 52/396.02
4,774,795 A * 10/1988 Braun ..... 52/396.07
4,784,516 A * 11/1988 Cox ..... 404/69
4,793,162 A 12/1988 Emmons
4,932,183 A * 6/1990 Coulston ..... 52/417
4,965,976 A * 10/1990 Riddle et al. ..... 52/396.05
4,979,846 A * 12/1990 Hill et al. ..... 404/65
5,035,533 A * 7/1991 Brown ..... 404/64
5,338,130 A * 8/1994 Baerveldt ..... 404/33
5,365,713 A 11/1994 Nicholas et al.
5,477,643 A * 12/1995 Koenig, Jr. ..... 52/100
5,628,857 A * 5/1997 Baerveldt ..... 156/244.25
6,018,918 A * 2/2000 Long, Sr. ..... 52/408
6,039,503 A * 3/2000 Cathey ..... 404/67
6,253,514 B1 * 7/2001 Jobe et al. ..... 52/471
6,298,621 B1 * 10/2001 Lee ..... 52/302.6
6,460,306 B1 * 10/2002 Nelson ..... 52/582.1

* cited by examiner

SEALING ELEMENT FOR EXPANSION JOINTS

This is a continuation of PCT/BR00/00081, filed Jul. 19, 2000.

FIELD OF THE INVENTION

The present invention refers to a sealing element for expansion joints in concrete structures, particularly in concrete structures in which the sealing element is submitted to large structural movements and high hydrostatic pressures, such as it occurs in dikes.

BACKGROUND OF THE INVENTION

Among the known sealing techniques presently used in dikes, there can be mentioned the sealing elements made of copper, PVC mats, elastomeric profiles (butyl, neoprene) which are resistant to harsh weather conditions, alkalis, fungi, musts, oils, greases and other agents, or also silicone or polyurethane-based mastics.

Although being widely used and presenting operational results which meet the requirements of the concrete structure to which they are applied, these known sealing elements have a slow and expensive application and do not allow repair or recovering, in case there is an accident or localized rupture in the sealing element, after they have been installed and have begun to operate in the concrete structure.

DISCLOSURE OF THE INVENTION

Thus, the object of the present invention is to provide a sealing element for expansion joints of concrete structures, which has a simple construction, resistant to harsh weather conditions and other deteriorating agents, which is elastically deformable together with the structure, which may be submitted to high hydrostatic pressures, with no risk of impairing its sealing characteristics, and which allows repairs of eventual leaks to be carried out after the sealing element has begun to operate in the concrete structure to which it has been applied.

This and other objectives of the invention are achieved by a sealing element for expansion joints provided with a seat, which is recessed in relation to the adjacent end edges of the expansion joint upstream a concrete structure.

According to the invention, the sealing element comprises an elastomeric profile consisting of two longitudinal lateral flanges to be glued onto said end edges of the expansion joint, and a central portion, to be fitted inside the seat and which is shaped in order to support the hydrostatic pressures upstream the concrete structure; and a flexible duct, of high pressure, which is installed inside the seat and provided with radial bores opened to the inside of the latter, downstream the elastomeric profile, and having at least one end which may be accessed from the outside of the concrete structure, so as to allow the selective feeding of pre-catalyzed polymeric resin to the inside of the seat, after the elastomeric profile has been mounted and affixed to the concrete structure.

The above cited constructive arrangement allows, by means of adequately injecting, under high pressure, a pre-catalyzed polymeric resin inside the flexible duct, to seal any leak that may occur along the joint, making possible to simply and rapidly repair the sealing elements, which repair would otherwise be impracticable or at least extremely complex and expensive, as it occurs in dikes.

BRIEF DESCRIPTION OF THE DRAWINGS

The invention will be described with reference to the attached drawings, in which.

BEST MODE OF CARRYING OUT THE INVENTION

Figure 1:
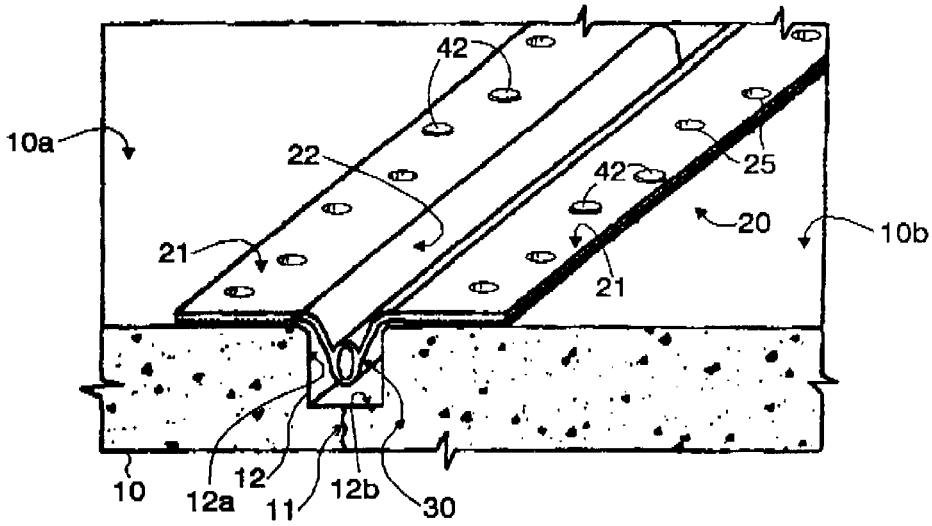
FIG. 1 is a perspective view of an extension of the sealing element, according to a first embodiment of the invention and applied to the seat of the expansion joint of a concrete structure.

According to the above cited illustrations, the sealing element of the present invention is applicable to the expansion joint 11 of a concrete structure 10, in order to seal this expansion joint 11 on the upstream face of the concrete structure, to which hydrostatic pressure is directly applied, in the case of dikes.

For the application of the sealing element, the expansion joint 11 is provided with a seat 12, which is recessed in relation to the adjacent end edges 10*a*, 10*b* of the expansion joint 11, upstream the concrete structure 10. In the illustrated embodiments, the seat 12 has a rectangular cross-section with lateral walls 12*a* and a bottom wall 12*b*, it being understood that this cross-section may have an inverted trapezoidal shape, or even be "V" shaped, with the bottom wall 12*b* being defined by the vertex or junction of the lateral walls 12*a*. It is also possible to apply the present sealing element to expansion joints, whose seat 12 lacks a bottom wall and extends throughout the whole thickness of the concrete structure.

According to the invention, the sealing element comprises an elastomeric profile which is pressed, calendered or extruded and vulcanized in its definitive form, in order to increase its resistance and reduce the porosity, and which consists of two longitudinal lateral flanges 21, to be glued, usually by an epoxy adhesive, onto the end edges 10*a*, 10*b* of the concrete structure 10, on both sides of the seat 12, and a central portion 22, which is fittable inside the seat 12 and generally shaped so as to be maintained at least partially seated against the lateral walls 12*a* and bottom wall 12*b* (if existing) of the seat 12 when submitted to hydrostatic pressure upstream the concrete structure 10. The central portion 22 is formed by a wall 22*a* depending from a respective flange 21 to be fitted in the seat 12 for supporting the hydrostatic pressures upstream the concrete structure 10, said central portion walls 22*a* converging from the flanges 21 to a central area 22*b*.

In a constructive form, the elastomeric profile 20 incorporates a reinforcing web 23 therewithin, made of synthetic fabric or steel and extending along the longitudinal lateral flanges 21 and the central portion 22. This reinforcing web 23 considerably increases the resistance of the assembly, without impairing the free movement thereof.

Aiming at increasing the gluing area and the shear strength, allowing a non-concentrated distribution of efforts, avoiding tensions on the joint edges and the possibility of rupture in the concrete at 45°, the longitudinal lateral flanges 21 have large width and the faces thereof to be glued to the concrete structure 10 are provided with longitudinal grooves 24 which are mutually parallel and adjacent.

In the illustrated constructions, the longitudinal lateral flanges 21 have a thickness superior to that of the central portion 22 by a value substantially corresponding to the depth of the longitudinal grooves 24.

The longitudinal lateral flanges 21 are further provided with throughbores 25 along their extension, in order to facilitate the introduction of pins 42 to be affixed to the concrete structure 10.

Figure 2:
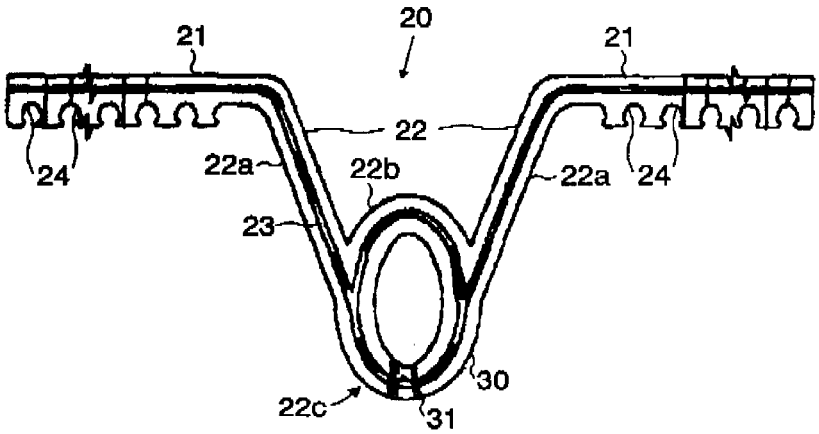
FIG. 2 is an enlarged cross-sectional view of the sealing element illustrated in FIG. 1.
Figure 6:
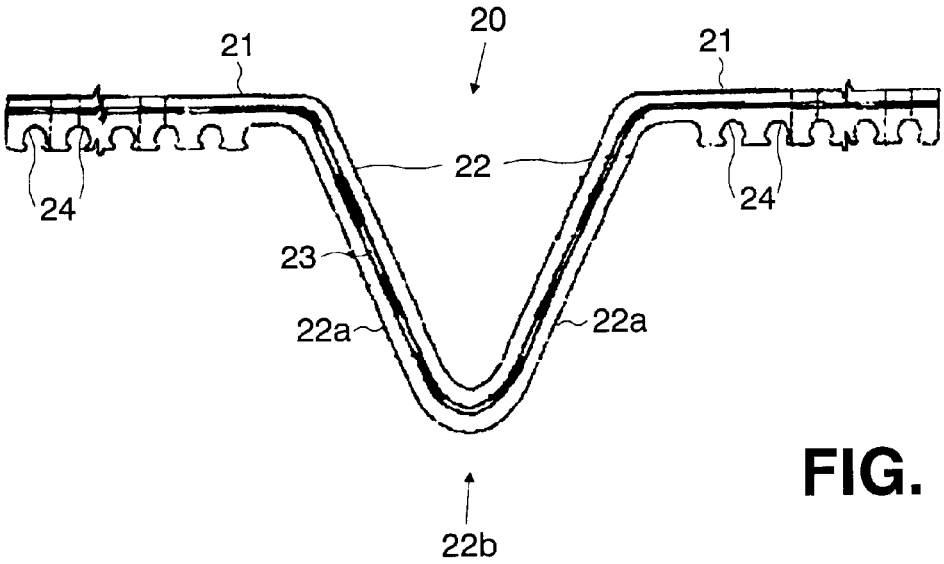
FIG. 6 is an enlarged cross-sectional view of another embodiment of the sealing element used in the arrangement illustrated in FIG. 3.

In the embodiment illustrated in FIGS. 1 and 2, the sealing element further comprises a flexible duct 30, of high pressure, with a preferably elliptical cross-section and which is incorporated as a single piece in a vertex 22*c* of the "V" shaped central portion 22 of the elastomeric profile 20. The flexible duct 30 incorporates, in this embodiment, the same reinforcing web 23 that is incorporated in the remaining of the elastomeric profile 20. However, it should be understood that, even if the elastomeric profile 20 has a "V" shaped central portion 22, as shown in FIG. 6, the flexible duct 30 may be defined by a separate piece, which is lodged inside the seat 12 upstream the central portion 22 of the elastomeric profile 20. Independently of the constructive form of the flexible duct 30, the latter is provided, usually at every 30 cm, with a radial hole 31 opened to the inside of the seat 12 upstream the elastomeric profile 20, in order to allow a pre-catalyzed polymeric resin 40 to be fed inside the seat 12, after the elastomeric profile 20 has been mounted and affixed to the concrete structure 10. This resin 40 will occupy the available spaces, in case defects or ruptures occur in the elastomeric profile, allowing the sealing to be recovered.

The flexible duct 30 is extended along the whole length of the expansion joint 11, so as to have at least one end thereof accessible from the inside of the concrete structure.

Figure 3:
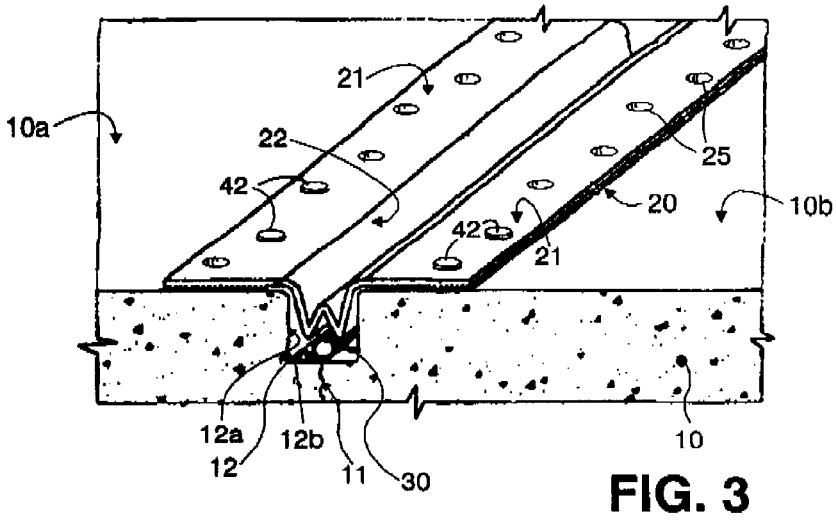
FIG. 3 is a similar view to that of FIG. 1, but illustrating a second embodiment for the sealing element applied to the seat of an expansion joint in a concrete structure.
Figure 4:
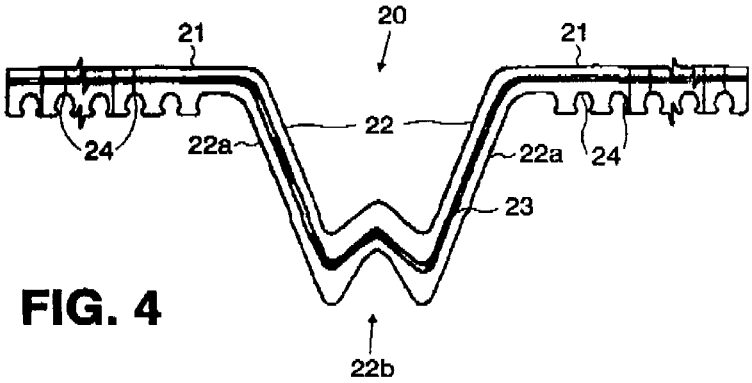
FIG. 4 is an enlarged cross-sectional view of the sealing element illustrated in FIG. 3.
Figure 5:
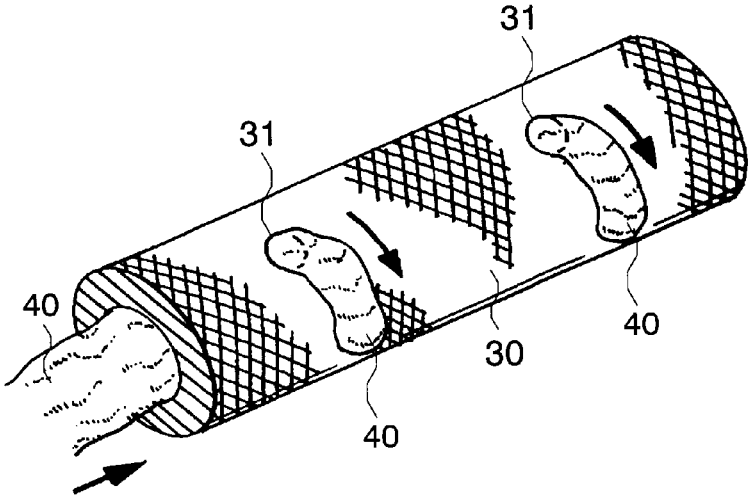
FIG. 5 is a perspective view of an extension of the flexible duct illustrated in FIG. 3.

In the embodiment of FIGS. 3 and 4, the central portion 22 of the elastomeric profile 20 takes a "W" form and the flexible duct 30 is now a separate piece. This elastomeric profile 20 with a "W" shaped central portion 22 is preferably used in the expansion joints 11 more subjected to tensile strength, differential settlement and shear when the concrete structure 10 begins to operate, permitting a higher capacity of accomodating to these efforts. The other characteristics of the elastomeric profile 20 of FIGS. 3 and 4 are the same as already described in relation to the elastomeric profile shown in FIGS. 1 and 2.

In the expansion joints 11 in which the seat 12 extends throughout the whole thickness of the concrete structure 10, the flexible duct 30, in a separate piece, is dimensioned so as to have a diameter which is slightly larger than the width of the joint gap in the place where it is lodged.

As set forth in the appended claims, the central portion 22 of the elastomeric profile 20 may be "U" shaped or have another geometric profile, adequate to each specific case considering the structural movements and the hydrostatic pressures.

What is claimed is:

1. A sealing element for an expansion joint in a recessed seat in a concrete structure, said sealing element comprising:

a profile of elastomeric material having:

two longitudinal lateral flanges to lie on the end edges of the concrete structure;

a central portion formed by a wall depending from a respective flange to be fitted in the seat for supporting the hydrostatic pressures upstream the concrete structure, wherein said central portion is disposed entirely below said longitudinal lateral flanges and the seat, said central portion walls converging from the flanges to a central area;

a flexible duct of high pressure material installed inside the seat and entirely below said central portion central area and provided with radial holes opened to the inside of the seat, said flexible duct having at least one end which is accessible from the outside of the concrete structure to allow the selective feeding of a polymeric resin through said duct to the inside of the seat, after the elastomeric profile has been mounted onto the concrete structure.

2. Sealing element as in claim 1, wherein said central area of said central portion of said elastomeric profile is of a "W" shape.

3. Sealing element, according to claim 1 wherein said flexible duct is incorporated in said central area of said central portion.

4. Sealing element, as in claim 3 wherein said converging walls of said central portion converge at a vertex defined by said flexible duct.

5. Sealing element according to claim 1 wherein the flexible duct is provided between a bottom wall of the seat and said central area of said central portion.

6. Sealing element according to claim 1 wherein each said longitudinal lateral flange has a face to be glued to the concrete structure, said face provided with longitudinal grooves which are mutually parallel and adjacent.

7. Sealing element, according to claim 1 wherein said elastomeric profile includes a reinforcing web made of synthetic fabric or steel extending along said longitudinal lateral flanges and said central portion.

8. Sealing element according to claim 1 further comprising an adhesive to attach said sealing element flanges to said concrete structure.

9. Sealing element according to claim 1 further comprising pins to extend through said flanges to attach said sealing element flanges to the concrete structure.

10. Sealing element, according to claim 2 wherein the flexible duct is in the bottom of the lower part of the W of the central area of the central portion.

11. Sealing element, according to claim 2 wherein the elastomeric profile is provided with reinforcing web made of synthetic fabric or steel extending along the longitudinal lateral flanges and the central portion.

* * * * *